United States Patent [19]

Wilcox et al.

[11] 4,371,293

[45] Feb. 1, 1983

[54] MINE ROOF BEARING PLATE

[76] Inventors: Raymond J. Wilcox, 201 Ocean Ave., Santa Monica, Calif. 90402; Earl W. Powers, 502 Berland Way, Chula Vista, Calif. 92011

[21] Appl. No.: 177,854

[22] Filed: Aug. 14, 1980

Related U.S. Application Data

[63] Continuation of Ser. No. 945,490, Sep. 25, 1978, abandoned.

[51] Int. Cl.[3] ..... E21D 21/00

[52] U.S. Cl. ..... 405/259; 411/531

[58] Field of Search ..... 405/132, 259–262, 405/288; D8/399; 411/531

[56] References Cited

U.S. PATENT DOCUMENTS

| | | | |
|---|---|---|---|
| D. 236,428 | 8/1975 | Stewart et al. | D8/399 |
| 2,748,594 | 6/1956 | Edwards | 405/259 |
| 2,854,824 | 10/1958 | Curry et al. | 405/259 |
| 3,090,203 | 5/1963 | Durget | 405/259 |
| 3,163,012 | 12/1964 | Dempsey | 405/259 |
| 3,238,731 | 3/1966 | Seifert et al. | 405/259 |
| 3,415,064 | 12/1968 | Talobre | 405/259 |
| 3,415,066 | 12/1968 | Williams | 405/260 |
| 3,478,523 | 11/1969 | Reusser et al. | 405/259 |
| 3,695,045 | 10/1972 | Williams | 405/260 |
| 4,095,431 | 6/1978 | Hannan | 405/259 |
| 4,112,693 | 9/1978 | Collin et al. | 405/259 X |

FOREIGN PATENT DOCUMENTS

| | | | |
|---|---|---|---|
| 1222640 | 6/1960 | France . | |
| 968630 | 9/1964 | United Kingdom | 405/259 |

OTHER PUBLICATIONS

"Tazewell Underground Roof Control Products and Services", Tazewell Industries.

"Keeping the Roof Over Your Head", Keystone Bolt Company, 1979.

*Primary Examiner*—David H. Corbin

*Attorney, Agent, or Firm*—Fleit & Jacobson

[57] ABSTRACT

A bearing plate for supporting a portion of a mine roof or similar surface. The bearing plate includes a substantially planar, roof-bearing portion having a roof-bearing surface. Also included is a substantially planar bolt-head bearing surface. The bolt-head bearing surface includes a concentrically located aperature adapted to receive a roof bolt having a bolt head. The bolt-head bearing surface is spaced from the planar roof-bearing portion and is substantially parallel to the roof-bearing surface. A vertical wall extends from the bolt-head bearing surface about its outer periphery. A reinforcing wall extends radially outward from the distal end of the vertical wall and merges with the roof-bearing portion. The reinforcing wall defines a first frusto-conical portion, the base of which is conterminous with the roof-bearing portion, and a second frusto-conical portion, the base of which merges with the distal end of the first frusto-conical portion. The diameter of the base of the second frusto-conical portion is less than the diameter of the distal end of the first frusto-conical portion. The roof bearing surface of the bearing plate, when in use, supports a portion of the mine roof in response to a bearing force applied to the bolt-head bearing surface by the roof bolt. Some embodiments of the subject bearing plate contain embossed reinforcing ribs and dimples in the planar bearing portion.

33 Claims, 11 Drawing Figures

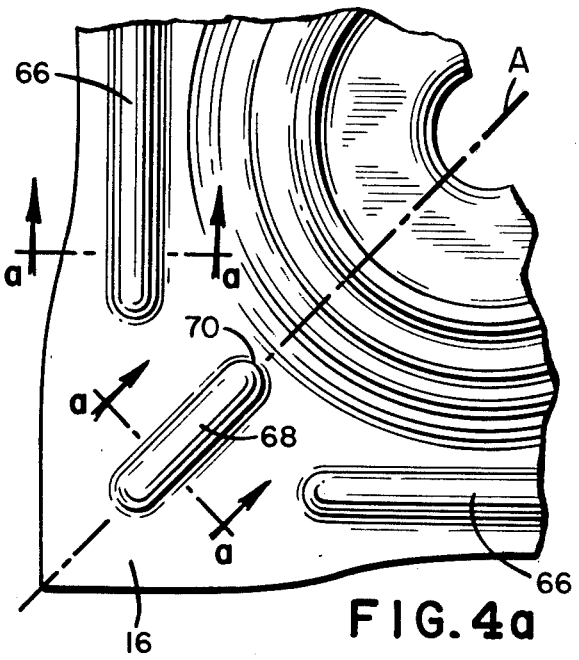
FIG. 4a
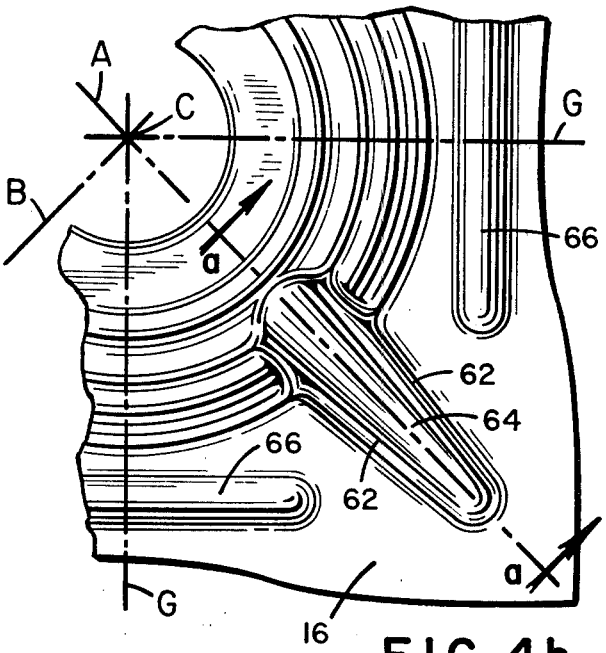
FIG. 4b
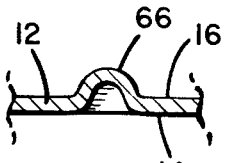
FIG. 5
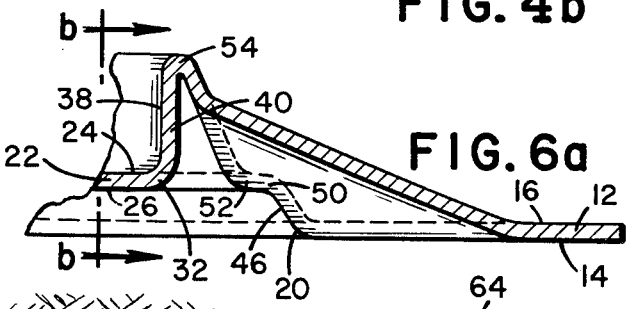
FIG. 6a
FIG. 6b
FIG. 9
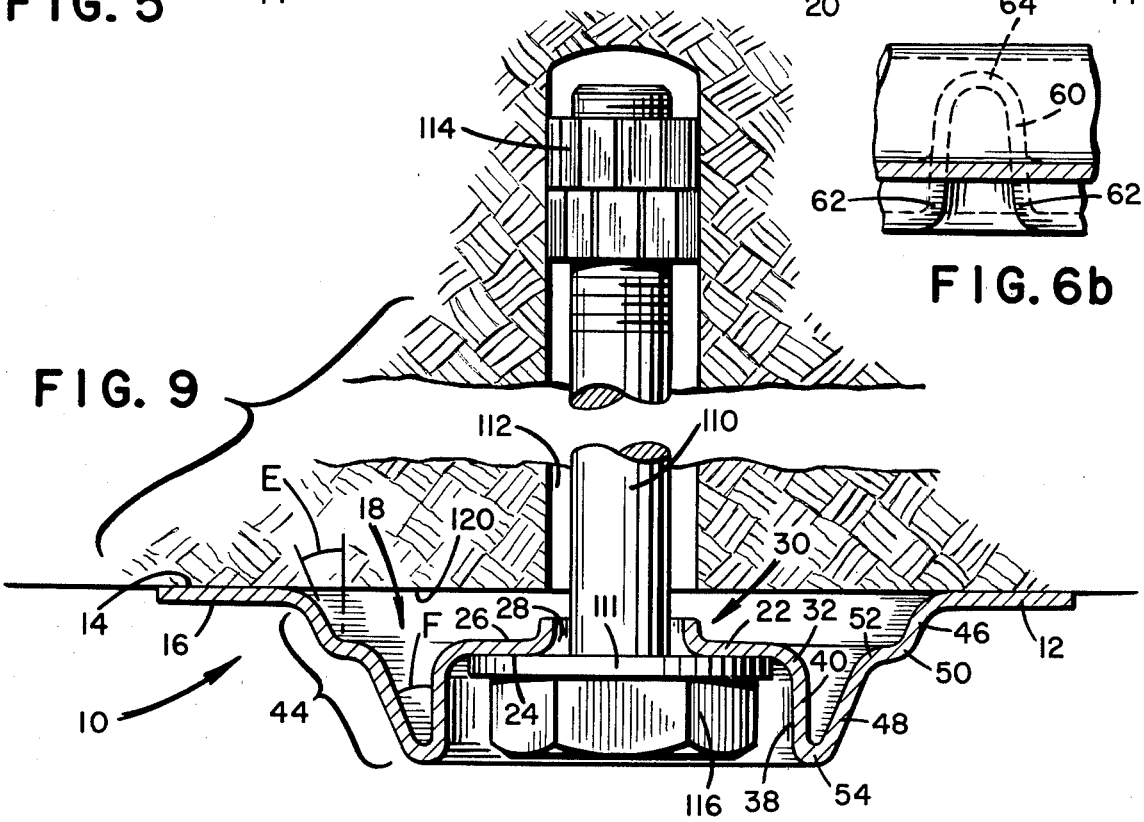

MINE ROOF BEARING PLATE

This is a continuation of application Ser. No. 945,490, filed Sept. 25, 1978, now abandoned.

BACKGROUND OF THE INVENTION

1. Field of the Invention

This invention relates to load-bearing plates adapted to provide support for a generally planar surface, in general, and to mine roof bearing plates, in particular.

2. Description of the Prior Art

Attempts have been made in the past to provide mine roof plates made from a relatively thin material and having a low silhouette structure. In addition, there are many known examples of mine roof plates exhibiting high strength and rigidity under bolt-loading by means of deep-dishing or excessive material thickness. However, in recent years there has been a trend in the mining industry toward the use of thinner plates in order to reduce cost, weight and installation problems.

While there have been a number of prior designs for mine roof bearing plates, those which have been most readily accepted as meeting governmental standards have taken one of two primary design configurations: the so-called "donut-type" and the "bell-type". The donut-type is embossed in a manner such that a portion thereof, taken in cross-section, looks very much like a donut; and the bell-type is embossed in a manner such that a cross-section thereof looks very much like a flattened bell. For the most part, these plates are made from a relatively expensive high-tensile grade steel. Many variations of these two basic concepts exist in the prior art.

The U.S. Bureau of Mines, in existing specifications relating to bearing plates, indicates that one of the most important features of a bearing plate is its ability to resist axial deflection when it is fully bolt-loaded. To measure axial deflection, the government working with the American Society for Testing and Materials (ASTM) has developed a standard test. A mine bearing plate under test is placed on a standard test plate which contains a four-inch diameter opening. Specific preloads are applied to the bearing plate with the resultant axial deflection being measured. The four-inch diameter figure has been selected because this represents the crumbling loss in the bearing area with loads concentrated adjacent to a bolt hole drilled in a mine roof. Presently, to confirm that a bearing plate is of sufficient rigidity, the axial deflection of the plate, as it is bolt-loaded from 6,000 to 15,000 pounds, should be no greater than 0.120 inches. The deflection of the plate, as it is bolt-loaded from 6,000 to 20,000 pounds, should be no greater than 0.250 inches.

There is, thus, a need for a bearing plate made from a thinner and less expensive material than has heretofore been possible and which still meets or exceeds all government standards. The subject invention is directed toward filling that need.

BRIEF DESCRIPTION OF THE INVENTION

As used herein, the term "bearing plates" includes plate washers, mine roof plates, and header plates. A bearing plate is defined as a plate that serves to distribute the load from the exposed end of a bolt or threaded bar to the rock face or intermediate member. A header plate is a large rectangular bearing plate, usually six inches wide by sixteen to eighteen inches long, or any other shape with an equivalent area, used in substitution for wooden header blocks for wider distribution of the bolt load than is possible with standard bearing plates.

In accordance with the present invention, there is provided a bearing plate for supporting a portion of a mine roof or similar surface. The bearing plate includes a substantially planar, roof-bearing portion having a roof-bearing surface. Also included is a substantially planar bolt-head bearing surface. The bolt-head bearing surface includes a concentrically located aperture adapted to receive a roof bolt having a bolt head. The bolt-head bearing surface is spaced from the planar roof-bearing portion and is substantially parallel to the roof-bearing surface. A vertical wall extends from the bolt-head bearing surface about its outer periphery. A reinforcing wall extends radially outward from the distal end of the vertical wall and merges with the roof-bearing portion. The reinforcing wall defines a first frusto-conical portion, the base of which is conterminous with the roof-bearing portion, and a second frusto-conical portion, the base of which merges with the distal end of the first frusto-conical portion. The diameter of the base of the second frusto-conical portion is less than the diameter of the distal end of the first frusto-conical portion. The roof-bearing surface of the bearing plate, when in use, supports a portion of the mine roof in response to a bearing force applied to the bolt-head bearing surface by the roof bolt. Some embodiments of the subject bearing plate contain embossed reinforcing ribs and dimples in the planar bearing portion.

It is an object of the present invention to provide a bearing plate made of a thinner material than has heretofore been possible, while meeting or exceeding present government standards for such plates.

It is another object of the present invention to provide a bearing plate which exceeds present government standards concerning minimum axial deflection.

It is still another object of the present invention to provide a bearing plate made from less expensive material than has heretofore been possible, while meeting or exceeding present government standards for such plates.

It is a further object of the present invention to provide a low-carbon steel bearing plate that meets or exceeds all present government standards for bearing plates.

It is yet an object of the present invention to provide a bearing plate having a unique embossed area to allow the bearing plate to be made from thinner, less expensive material than has heretofore been possible, while meeting or exceeding present government standards for such plates.

Other objects and advantages of this invention will further become apparent hereinafter and in the drawings, in which:

BRIEF DESCRIPTION OF THE DRAWINGS

FIG. 4*a* is a partial plan view showing a further modification of the mine roof plate of FIG. 3.

FIG. 4*b* is a partial plan view showing a portion of the mine roof plate of FIG. 3.

FIG. 5 is a section as viewed along lines a—a of FIG. 4a.

FIG. 6a is a section as viewed along lines a—a of FIG. 4b.

FIG. 6b is a section as viewed along lines b—b of FIG. 6a.

FIG. 9 is a cross-sectional view, partly in pictorial, showing a typical installation of the subject bearing plate.

DESCRIPTION OF THE PREFERRED EMBODIMENTS

Figure 1:
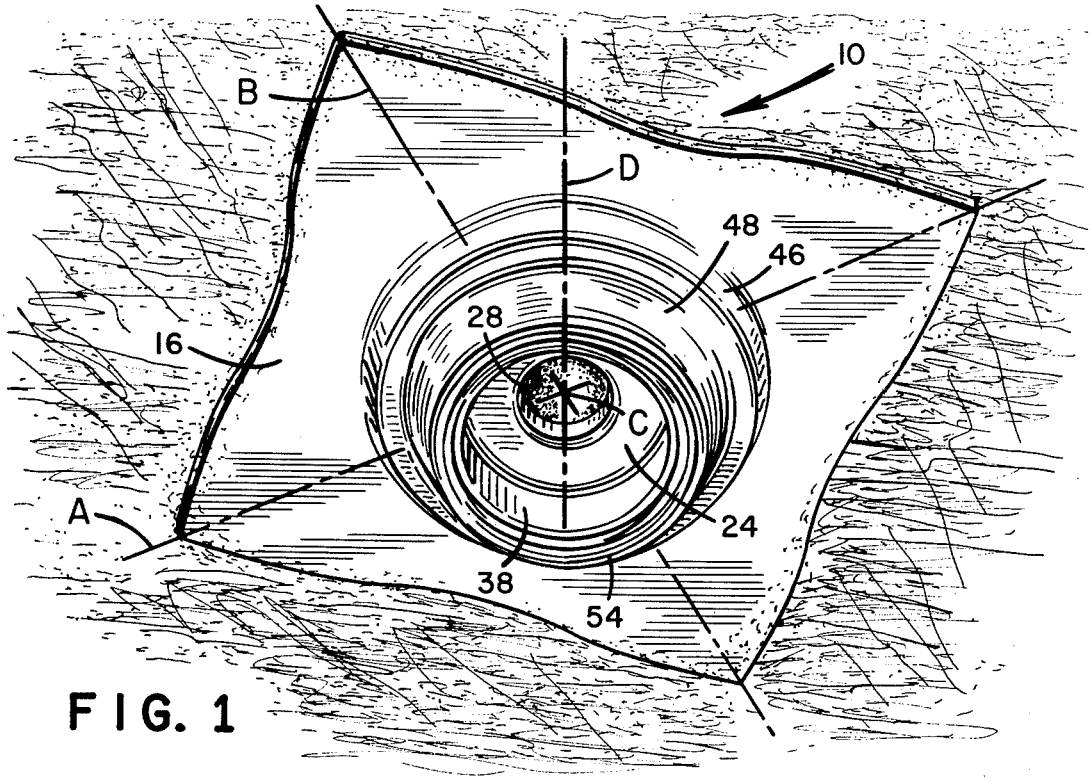
FIG. 1 is a perspective of a mine roof plate embodying the subject invention, and oriented in a position of use against a portion of a mine roof.

In describing the preferred embodiments of the invention illustrated in the drawings, specific terminology will be resorted to for the sake of clarity. However, it should be understood that the invention is not to be limited to the specific terms so selected, and it is to be further understood that each specific term includes all technical equivalents which operate in a similar manner to accomplish a similar purpose.

Figure 2:
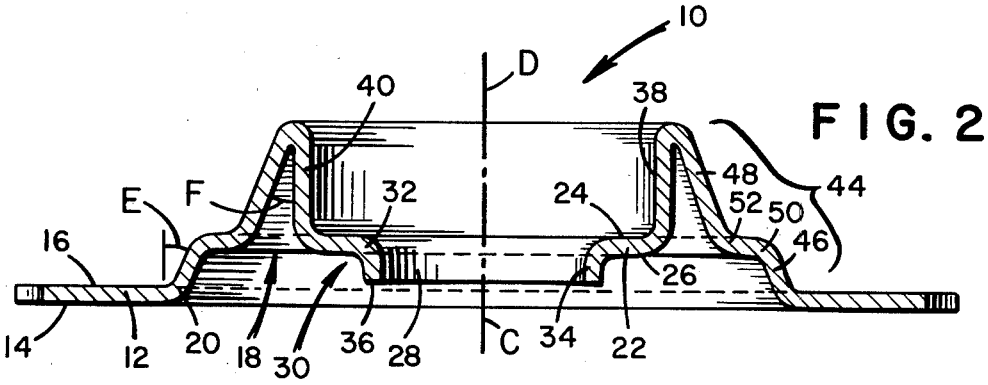
FIG. 2 is a cross-sectional view of a mine roof plate similar to that of FIG. 1.

Referring now to FIGS. 1 and 2, there is shown a bearing plate, also referred to as a mine roof plate, embodying the subject invention. The bearing plate, generally designated as 10, has a generally planar square body 12 having peripheral dimensions of approximately six inches square. The final bearing plate configuration is slightly deformed from the substantially square configuration due to material-gathering taking place during the manufacture of the plate. The bearing plate is preferably made from a low carbon steel which conforms to ASTM Specification F-543-77, Paragraph 6.1. It has been found that the subject invention is best practiced with a steel plate having a thickness in the range of about 0.074 inches to 0.150 inches, with a thickness of approximately 0.104 inches being preferred. One face 14 of the body defines a roof-bearing or support surface, while the opposed face 16 defines an outer surface. Diagonal lines A and B, drawn along the plane defined by the body 12, intersect at point C to define the center of the body. An axis D extends through point C and is perpendicular to the plane formed by the diagonals A and B.

Concentric about axis D, is an upwardly extending embossed area, generally designated as 18. The base of the embossed area 18 merges with the body 12 by means of a curved portion 20, which has an inner radius typically in the range 1/16 to 1/8 inch, with 1/16 being preferred. Curved portion 20, as well as any other curved portion referred to hereinafer, deviates from planarity in a smooth and continuous fashion.

With further reference to FIGS. 1 and 2, the structure of the embossed area 18 will now be described. An opening within the embossed area is defined by curved portion 20 and has a diameter which is typically 3.98 inches. Forming a portion of the embossed area is a substantially planar circumferential bolt-head bearing portion 22, which has a bolt-head bearing surface 24 and an opposite surface 26. Concentric about axis D is an aperture 28 located substantially at the center of the bolt-head bearing portion 22. The diameter of the aperture 28 varies according to the shank diameter of the roof bolt being used. The aperture 28 is bounded by a downwardly extending curved lip 30. The curved portion 32 of lip 30 has an inner radius which is typically 0.09 inches. The straight portion 34 of lip 30 terminates in a flat surface 36, which is typically at least ⅛ of an inch from a plane defined by bearing surface 14.

A substantially vertical wall 38 extends upwardly away from the bolt-head bearing surface 24 along the circumferential periphery or perimeter of the bolt-head bearing portion 22 to define a cylindrical portion 40 on the embossed area 18. The vertical wall is preferrably normal to the bolt-head bearing surface, but may deviate from this position within the range of about 0 to 5°. The cylindrical portion 40 has an inner diameter which is typically 2½ inches. The origin of the vertical wall 38 merges with the periphery of the bolt-head bearing portion 22 by means of curved portion 42, which has an inner radius which is typically in the range of about 0.14 inches to 0.20 inches.

Forming a further portion of the embossed area 18 is a reinforcing wall, generally designated as 44, which extends upwardly away from outer surface 16 and radially inward toward axis D. The reinforcing wall 44 is defined by two frusto-conical sections 46 and 48; both sections are concentric about axis D. The first frusto-conical section 46 is defined by a portion of a cone having a base diameter which is typically 3.98 inches and a vertex angle E typically in the range of about 15 to 30°, with 22° being preferred. The height of the first frusto-conical section 46, measured from its distal end to the plane defined by bearing surface 14 is typically 0.31 inches. The second frusto-conical section 48 is defined by a portion of a cone having a base diameter which is typically 3⅛ inches and a vertex angle F typically in the range of about 20 to 30°, with 22° being preferred. The base of the second frusto-conical section 48 merges into the distal end of the first frusto-conical section by means of curved portions 50 and 52. Curved portion 50 has an inner radius typically in the range of about 1/16 to ⅛ inches with 1/16 being preferred. Curved portion 52 has an inner radius typically in the range of about ⅛ to ¼ inches with ⅛ being preferred. To add further strength and rigidity to the reinforcing wall 44, the flat portion 51 between curves 50 and 52 should be kept to a minimum. The second frusto-conical section 48 terminates at its distal end at a distance which is typically 1-1/16 inches from the plane defined by bearing surface 14. The distal end of the vertical wall 38 merges with the distal end of the second frusto-conical portion 48 by means of curved portion 54, which has an inner radius typically of 0.03 inches or less.

Another embodiment of the subject invention is illustrated in FIGS. 3, 4b, 6a and 6b. In this regard, it should be noted that the elements which are the same are similarly numbered, and only the major differences will be discussed. For further strengthening and rigidity purposes, the bearing plate 10 contains a plurality of ribs 60, preferably in the form of an X-pattern with each rib being symmetric about one of the diagonals A and B. Each rib, which includes two side walls 62 joined together by a curved portion 64, merges into the reinforcing wall 44. At the merge area, the top of the curved portion 64 is typically ¾ of an inch from the plane defined by the bearing surface 14. The rib 60 gradually tapers until it merges into the outer surface 16 at some predefined distance from the center C of the bearing plate 10.

Figure 3:
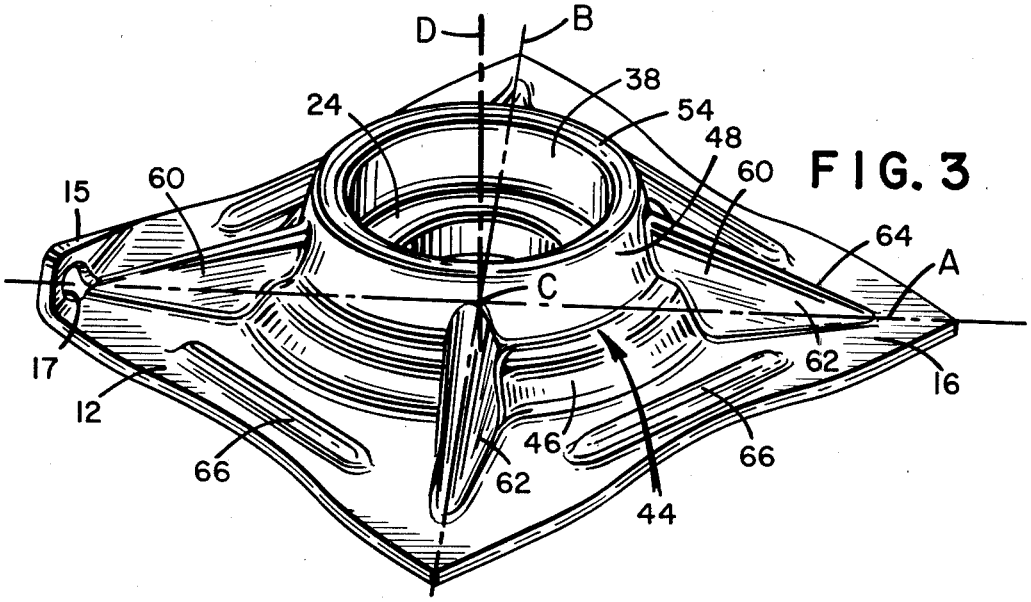
FIG. 3 is a perspective view of another mine roof plate embodying the subject invention.

A plurality of elongated dimples 66 are provided to impart additional strength and rigidity to the bearing plate 10. In the preferred embodiment, as shown in FIG. 46, each dimple 66 has a typical length of 2½ inches and a typical width of 3/16 inch. For purposes of explaining where the dimples 66 are located on the bearing plate 10, FIG. 4*b* shows two axes G,G which lie within the plane defined by the body 12 and which bisect the angles formed by the diagonals A and B. As best seen in FIGS. 4*b* and 5 each dimple 66 outwardly projects from the outer surface 16 and is positioned on the bearing plate 12 so that the transverse axis of each dimple is parallel to axis G, the dimple 66 is symmetric about the axis G, and the dimple's longitudinal axis at its midpoint is typically 2 5/16 inches from the center point C. As best seen in FIG. 3, body portion 12 contains a conventional hanger formed by turned up corner 15 and aperture 17. Such hangers are used for facilitating the installation of electrical wiring, lightling fixtures and telephone lines.

A further modification of the subject bearing plate is illustrated in FIG. 4*a*, in which a plurality of dimples 68 replace the ribs 60 of the previous embodiment. Each dimple 68 is similar in structure to dimple 66; the major difference being that dimple 68 has a typical length of 1¼ inches. Each dimple 68 extends outwardly from the outer surface 16 and is positioned on the bearing plate 10 so that the longitudinal axis of each dimple is parallel to one of the diagonals A or B, the dimple 68 is symmetric about one of the diagonals, and the dimple's end portion 70 is typically 2 3/16 inches from the center point C.

It is to be understood that the previous discussion concerning ribs 60, and dimples 66 and 68 is provided to give specific examples of the use of such ribs and dimples. It is contemplated that the specific structure of the ribs and dimples may be altered without departing from the teachings of the subject invention. It is also contemplated that the ribs and dimples may be provided for on the bearing plate 10 in combinations other than those previously mentioned.

Figure 7:
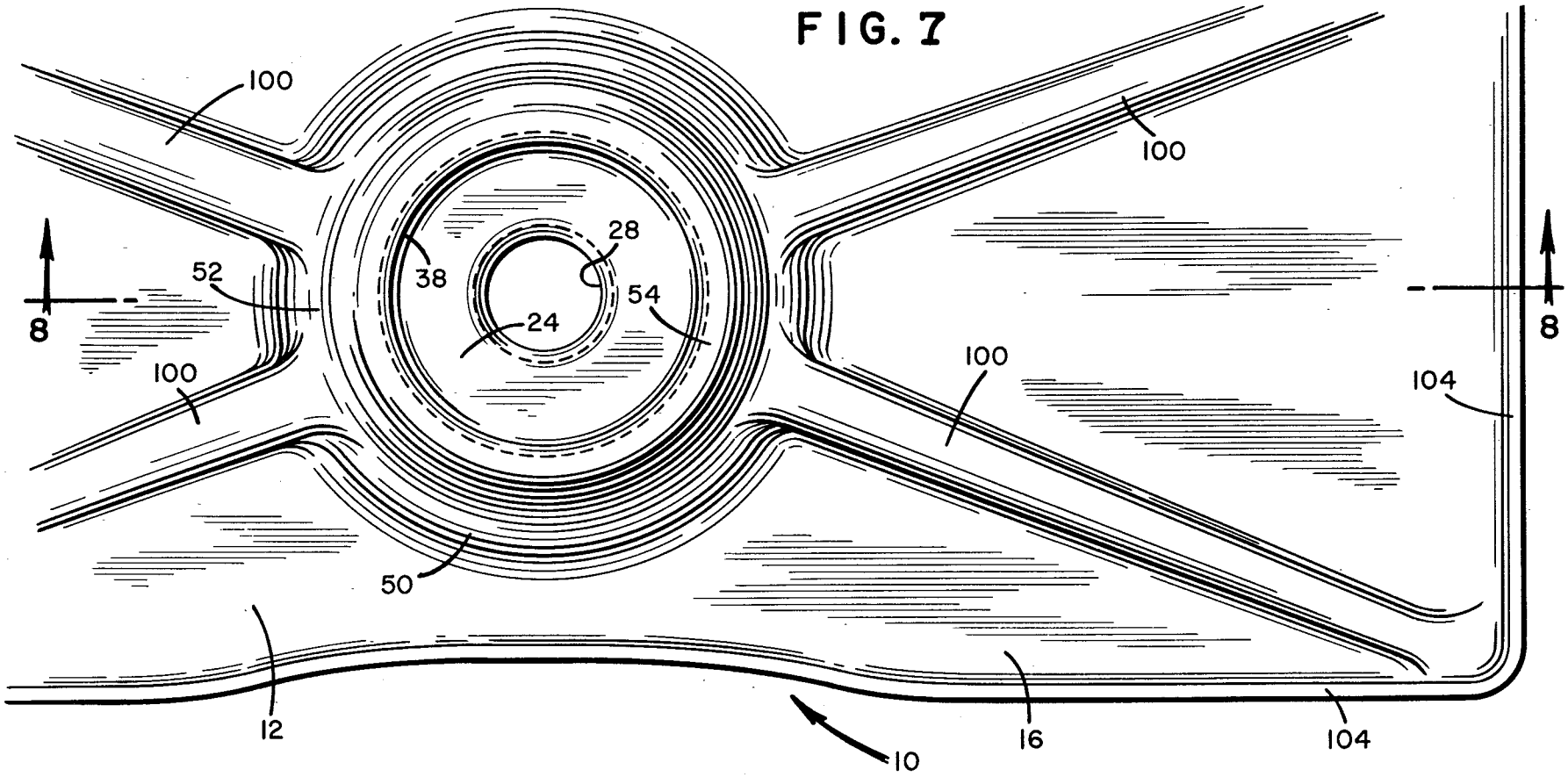
FIG. 7 is a plan view of a header plate embodying the subject invention.
Figure 8:
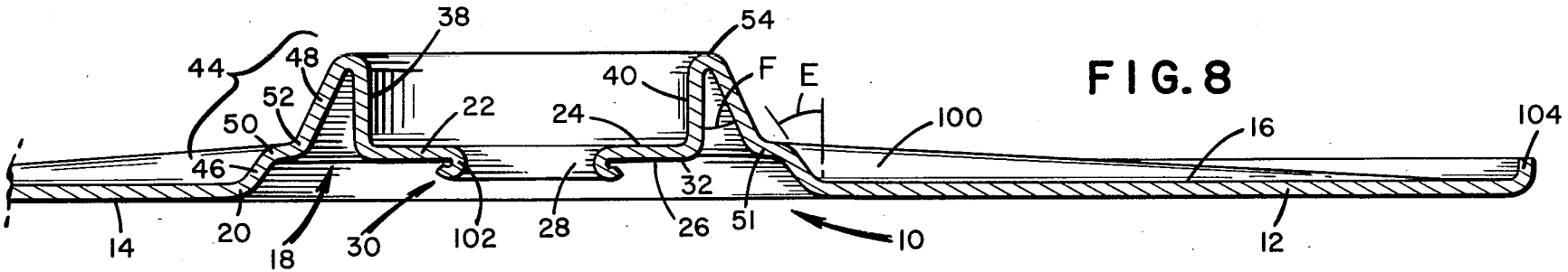
FIG. 8 is a longitudinal section as viewed along lines 8—8 of FIG. 7.

As best seen in FIGS. 7 and 8, another embodiment of the subject invention is illustrated. In this regard, it should be noted that the elements which are the same, are similarly numbered, and only the major differences will be discussed. In this embodiment, the subject invention is incorporated into a header plate, which, as stated hereinbefore, is a particular type of bearing plate, and, therefore, the major difference is the structure of the body portion 12. In this embodiment, the body portion 12 has a generally rectangular shape to provide for wider distribution of the bolt load than is possible with the previous embodiments of a bearing plate. The overall dimensions of this large rectangular bearing plate are approximately six inches wide by sixteen inches long. Except as noted below, the embossed area 18 is the same as that previously described for the first embodiment. In particular, in this embodiment vertex angle F is typically in the range of about 20° to 30° with 26° being preferred, and vertex angle E is typically in the range of about 15° to 30° with 26° being preferred. Further, the distance from the distal end of wall 38 to the plane defined by bearing surface 14 is typically 1.00 inches. Also, the lip 30 terminates in an extended curved portion 102, which approximates, when viewed in cross-section, half the circumference of a circle.

The ribs 100 in this embodiment are similar in structure and placement to the ribs 60 of the FIG. 3 embodiment. The ribs 100 merge with the reinforcing wall 44; the top of the rib meets the reinforcing wall at a point approximate to where the transition takes place between curved portions 50 and 52.

To add further rigidity and strength to the bearing plate, the periphery of the body 12 terminates in a curved lip 104, which extends away from and substantially normal to the outer surface 16. This arrangement, as well as curved portion 102, also may be used in the other embodiments previously described.

In the preferred embodiments, a low carbon steel, having a rating of at least 50,000 psi minimum yield strength, is contemplated for use in order to meet or surpass the strength requirements set by various governmental bodies. This represents a significant savings over high tensile steel, which is currently being widely used for the manufacture of bearing plates. Further, the thickness of the steel plate preferably used is typically on the order of 0.104 inches, which is significantly thinner than any other bearing plate currently being used or manufactured, thus providing additional economic advantages.

Referring now to FIG. 9, the installation of the subject bearing plate in a mine roof will now be described. The mine roof plate 10 contains the centrally-disposed aperture 28 for receiving a conventional roof bolt fastener 110. The fastening bolt 110 is adapted to be inserted into a suitable hole 112, which is drilled by conventional means into the strata of the mine roof. Any of several conventional anchoring devices or expansion shells 114 may be employed to secure the fastening bolt 110 in the opening 112. The fastening bolt 110 contains a conventional bolt head 116 for cooperating with the substantially planar bolt-head bearing surface 24 of the bearing plate 10 via a conventional washer 111 interposed between the surface 24 and the bolt head 116. In use, the bolt head 116 is concealed by the vertical wall 38.

The bolt 110, by conventional means applied to the bolt head 116, turns to expand the shell 114 and draw the plate 10 up against the mine roof 120. In this way, the bearing surface 14 of the plate 10 is brought into load bearing relationship with the surface of the mine roof 120.

When the bolt head 116, via the washer 111, applies a bearing force on the bolt-head bearing surface 24, the force is translated to the roof-bearing surface 14 via the vertical wall 38 and the reinforcing wall 44 to support a portion of the mine roof 120. The wall 38, by being substantially perpendicular to the bolt-head bearing surface 24, does not bend when the bearing force is applied to the bolt-head bearing surface 24; thus, the wall 38 adds additional strength and rigidity to the embossed area 18. The arrangement between the reinforcing wall 44 and the wall 38, afforded by the size of vertex angle F and the small radius of curved portion 54, provides the embossed area 18 with a structure which is highly resistant to deflection, resulting in a bearing plate which meets or exceeds government standards, while being made from thinner and less expensive materials.

Obviously, many modifications and variations of the present invention are possible in light of the above teachings, and it is, therefore, to be understood that, within the scope of the appended claims, the invention may be practiced otherwise than as specifically described.

What is claimed is:

1. A bearing plate for supporting a portion of a mine roof or similar surface, said bearing plate comprising:

roof-bearing means including a substantially planar roof-bearing surface for supporting said portion of said mine roof;

bolt-head bearing means including a substantially planar, circumferential bolt-head bearing surface that terminates in a perimeter, said bolt-head bearing surface being concentric about an axis that is perpendicular to said planar roof-bearing surface, said bolt-head bearing surface having an aperture adapted to receive a roof bolt having a bolt head, said aperture being concentric about said axis;

a wall disposed completely around said perimeter of said bolt-head bearing surface and being oriented normal to said roof-bearing surface, said wall extending away from said bolt-head bearing surface to define a cylindrical portion having a distal end spaced from said bolt-head bearing surface;

means for connecting said cylindrical portion to said perimeter of said bolt-head bearing surface; and reinforcing means connecting the distal end of said cylindrical portion with said roof-bearing means for translating a bearing force applied to said bolt-head bearing means by said bolt-head to said bearing surface for supporting said portion of said mine roof.

2. The bearing plate of claim 1, wherein said roof-bearing means comprises a substantially planar body portion having a periphery, said roof-bearing surface, and an outer surface.

3. The bearing plate of claim 2, further comprising lip means about said periphery for adding strength and rigidity to said bearing plate.

4. The bearing plate of claim 3, wherein said lip means extends away from and perpendicular to said outer surface.

5. The bearing plate of claim 2, wherein said bolt-head bearing means, said wall, and said reinforcing means constitute an embossed area on said planar body portion.

6. The bearing plate of claim 2, wherein said bearing plate further comprises at least one elongated rib portion extending outwardly from said outer surface to provide added strength and rigidity to said bearing plate.

7. The bearing plate of claim 6, wherein one end of said rib merges with said reinforcing wall means, the height of said rib tapering to a point where said rib merges with said outer surface.

8. The bearing plate of claim 7, wherein four of said ribs are arranged on said outer surface to form an X-pattern about said reinforcing wall means.

9. The bearing plate of claim 2, wherein said bearing plate further comprises at least one elongated dimple means extending outwardly from said outer surface for providing added strength and rigidity to said bearing plate.

10. The bearing plate of claim 1, wherein said bearing plate is made from a low carbon steel.

11. The bearing plate of claim 1, wherein said bearing plate has a thickness in the range of about 0.074 inches to 0.150 inches.

12. The bearing plate of claim 1, wherein said bearing plate has a thickness of approximately 0.104 inches.

13. A bearing plate for supporting a portion of a mine roof or similar surface, said bearing plate comprising:

roof-bearing means including a substantially planar roof-bearing surface for supporting said portion of said mine roof;

bolt-head bearing means defining an aperture adapted to receive a roof bolt having a bolt head, said aperture being concentric about an axis that is perpendicular to said planar roof-bearing surface;

a reinforcing wall including a first substantially frusto-conical portion concentric about said axis, said first frusto-conical portion having a base connected to and surrounded by said planar roof-bearing surface of said roof-bearing means and a distal end spaced therefrom, a second substantially frusto-conical portion concentric about said axis, said second frusto-conical portion having a base and a distal end spaced therefrom, and first wall means connecting the base of the second frusto-conical portion with the distal end of said first frusto-conical portion, the diameter of the base of said second frusto-conical portion being less than the diameter of the distal end of said first frusto-conical portion; and second wall means connecting the distal end of said second frusto-conical portion with said bolt-head bearing means for translating a bearing force applied to said bolt-head bearing means by said bolt head to said bearing surface for supporting said portion of said mine roof.

14. The bearing plate of claim 13, wherein said roof-bearing means comprises a substantially planar body portion having a periphery, said roof-bearing surface, and an outer surface.

15. The bearing plate of claim 14, further comprising lip means about said periphery adding strength and rigidity to said bearing plate.

16. The bearing plate of claim 15, wherein said lip means extends away from and perpendicular to said outer surface.

17. The bearing plate of claim 14, wherein said bolt-head bearing means, said first wall means, and said reinforcing wall constitute an embossed area on said planar body portion.

18. The bearing plate of claim 14, wherein said bearing plate further comprises at least one elongated rib portion extending outwardly from said outer surface to provide added strength and rigidity to said bearing plate.

19. The bearing plate of claim 18, wherein one end of said rib merges with said reinforcing wall, the height of said rib tapering to a point where said rib merges with said outer surface.

20. The bearing plate of claim 19, wherein four of said ribs are arranged on said outer surface to form an X-pattern about said reinforcing wall.

21. The bearing plate of claim 14, wherein said bearing plate further comprises at least one elongated dimple means extending outwardly from said outer surface for providing added strength and rigidity to said bearing plate.

22. The bearing plate of claim 13, wherein said second frusto-conical portion has a vertex angle in the range of about 20° to 30°.

23. The bearing plate of claim 13, wherein said second frusto-conical portion has a vertex angle of 22°.

24. The bearing plate of claim 13, wherein said second frusto-conical portion has a vertex angle of 26°.

25. The bearing plate of claim 13, wherein said first frusto-conical portion has a vertex angle in the range of about 15° to 30°.

26. The bearing plate of claim 13, wherein said first frusto-conical portion has a vertex angle of 22°.

27. The bearing plate of claim 13, wherein said first frusto-concial portion has a vertex angle of 26°.

28. A bearing plate for supporting a portion of a mine roof or similar surface, said bearing plate comprising:

a substantially planar roof-bearing portion including a roof-bearing surface and an outer surface;

a substantially planar circumferential portion having a bolt-head bearing surface and an opposite surface, said bolt-head bearing surface terminating in a perimeter, said bolt-head surface being concentric about an axis that is perpendicular to said planar roof-bearing portion, said circumferential portion including a concentrically located aperture adapted to receive a roof bolt having a bolt head, said opposite surface facing said outer surface, said circumferential portion spaced from and substantially parallel to said roof-bearing portion;

a perimeter wall extending from said perimeter of said bolt-head bearing surface completely around said perimeter to define a cylindrical portion having a distal end spaced from said bolt-head bearing surface, said perimeter wall being normal to said bolt-head bearing surface;

means for connecting said cylindrical portion to said perimeter of said bolt-head bearing surface; and a reinforcing wall extending radially outward from the distal end of said cylindrical portion and toward the outer surface of said roof-bearing portion to merge with said roof-bearing portion, wherein a bearing force applied to said bolt-head bearing surface by said bolt head is translated to said roof-bearing surface to support said portion of said mine roof.

29. The bearing plate of claim 28, wherein said aperture is bounded by a lip extending away from said opposite surface.

30. The bearing plate of claim 29, wherein said lip is a curved lip which, when viewed in cross-section, approximates half the circumference of a circle.

31. A bearing plate for supporting a portion of a mine roof or similar surface, said bearing plate comprising:

a substantially planar roof-bearing portion including a roof-bearing surface and an outer surface;

an embossed area extending outwardly from said outer surface, said embossed area defining, a substantially planar circumferential portion having a bolt-head bearing surface and an opposite surface, said bolt-head bearing surface terminating in a perimeter, said bolt-head surface being concentric about an axis that is perpendicular to said planar roof-bearing surface, said circumferential portion including an aperture adapted to receive a roof bolt having a bolt-head, said aperture being concentric about said axis, said opposite surface facing said outer surface, said circumferential portion spaced from and substantially parallel to said roof-bearing portion, a reinforcing wall extending outwardly from said outer surface, said reinforcing wall including a first substantially frusto-conical portion having a base which is conterminous with said outer surface and a distal end spaced therefrom, and a second substantially frusto-conical portion having a base which merges with the distal end of said first frusto-conical portion and a distal end spaced therefrom, the diameter of the base of said second frusto-conical portion being less than the diameter of the distal end of said first frusto-conical portion; and a wall extending from said bolt-head bearing surface completely around said perimeter of said circumferential portion to the distal end of said second frusto-conical portion, said wall being oriented normal to said bolt-head bearing surface, wherein a bearing force applied to said bolt-head bearing surface by said bolt head is translated to said roof-bearing surface to support said portion of said mine roof.

32. The bearing plate of claim 31, wherein said aperture is bounded by a lip extending away from said opposite surface.

33. The bearing plate of claim 32, wherein said lip is a curved lip which, when viewed in cross-section, approximates half the circumference of a circle.

* * * * *